United States Patent [19]

Hashimoto et al.

[11] Patent Number: 4,574,786

[45] Date of Patent: Mar. 11, 1986

[54] MASSAGE APPARATUS

[75] Inventors: Kouichi Hashimoto, Shiga; Teruhisa Innami, Hikone; Ken Kakino, Hikone; Yukio Yamamura, Hikone, all of Japan

[73] Assignee: Matsushita Electric Works, Ltd., Osaka, Japan

[21] Appl. No.: 585,047

[22] Filed: Mar. 1, 1984

[30] Foreign Application Priority Data

Apr. 25, 1983 [JP] Japan ..... 58-72539

[51] Int. Cl.[4] ..... A61H 15/00

[52] U.S. Cl. ..... 128/52; 74/89.18; 74/422; 128/57; 297/DIG. 2; 297/460

[58] Field of Search ..... 74/89.17, 89.18, 422, 74/40, 51; 128/25 R, 25 B, 33–36, 31, 39, 41, 44–46, 48, 49, 51, 52, 56, 57, 67; 188/32; 366/111; 272/73, 134, 900; 5/60–65, 108, 109, 423, 449, 453, 433, 462, 464, 469; 269/328, 325, 60, 69; 297/337, 338, 345, 346, 423, 429, 374, 375, 377, 452

[56] References Cited

U.S. PATENT DOCUMENTS

| | | | |
|---|---|---|---|
| 2,614,955 | 10/1952 | Halsall | 264/257 |
| 2,808,875 | 10/1957 | Bargen | 297/DIG. 2 |
| 3,043,293 | 7/1962 | Rider | 128/52 |
| 3,055,058 | 9/1962 | Van Hartesveldt | 264/257 |
| 3,213,570 | 10/1965 | Abramson | 297/DIG. 2 |
| 4,167,182 | 9/1979 | Yamamura | 128/56 |
| 4,168,595 | 9/1979 | Pickles | 74/422 |
| 4,177,804 | 12/1979 | Weingarten | 128/52 |
| 4,270,404 | 6/1981 | Murakoshi | 74/422 |
| 4,280,976 | 7/1981 | Holdt | 264/318 |
| 4,412,534 | 11/1983 | Hamabe et al. | 128/52 |
| 4,422,449 | 12/1983 | Hamabe | 128/56 |

FOREIGN PATENT DOCUMENTS

| | | | |
|---|---|---|---|
| 60934 | 9/1982 | European Pat. Off. | 128/57 |
| 506936 | 6/1939 | United Kingdom | 264/318 |

*Primary Examiner*—Clyde I. Coughenour

*Attorney, Agent, or Firm*—Pollock, Vande Sande & Priddy

[57] ABSTRACT

A massage apparatus having a movable massaging assembly is disclosed herein. The apparatus comprises a front open boxlike base member molded from plastic to have a closed bottom and side walls extending forwardly from the lateral sides thereof. A front cover closing the front opening of the base member is cooperative therewith to define a space for receiving therein the massaging assembly. The plastic base member is provided at its lateral sides with racks each of which extends longitudinally of the base member to be in meshing engagement with each one of the pinions provided on the massaging assembly, such that the assembly is guided along the racks to move in the longitudinal direction of the base member by applying a massaging force through the front cover to the back of a user resting on the front cover. Thus, the base member itself can movably hold the massaging assembly without requiring an additional supporting frame while guarding or protecting the assembly by its closed bottom, enabling the lightweight construction of the apparatus.

6 Claims, 9 Drawing Figures

1
40
12
11
65
4
43
80
72
14
73
71
74
29
21
2
37
10
85
81
9
83
8
84
23
82
33
70
3
76
93
9
95
92
20

MASSAGE APPARATUS

BACKGROUND OF THE DISCLOSURE

1. Fields of the Invention

This invention is directed to a massage apparatus, more particularly to a massage apparatus having a movable massaging assembly and being adapted in use to be in the form of a chair in which the massaging assembly moves up and down or in the form of a bed in which the massaging assembly moves in the lengthwise direction thereof.

2. Description of the Prior Art

In prior massage apparatus provided with a massaging assembly moving in the above manner, a frame carrying the massaging assembly and a runway or guideway for guiding the assembly are made of metal pipes and plates, which renders the apparatus to be undesirably heavy in weight and therefore results in the lack of portability. In addition, the prior massage apparatus in the form of a chair to have the massaging assembly in the backrest of the chair must require an additional back cover for guarding purpose. The back cover normally made of fabric and plastic sheet to be fastened to the frame will certainly add the complexity to the assembling procedure. Such back cover indispensable to the massage apparatus of chair-type having the massaging assembly in the backrest is also preferable for other types of massage apparatus such as a massage bed for the same reason.

SUMMARY OF THE INVENTION

The above disadvantages have been eliminated by the present invention which comprises a front open boxlike base member made of plastic material for receiving therein a massaging assembly movable longitudinally of the base member. The base member of the present invention is shaped to have a closed bottom and side walls extending forwardly from the respective lateral sides thereof. The front opening of the base member is closed by a front cover through which the massaging action of the massaging assembly is applied to the back of a user resting on the front cover. Said base member is provided with a pair of racks each extending longitudinally of the base member at the portion adjacent to each side wall, such that pinions provided on the massaging assembly are in meshing engagement with the corresponding racks to be movable therealong. With the result of this, the base member, being of lightweight construction inherent to the plastic material from which it is made, servees as a supporting frame to carry the massaging assembly while protecting or guarding that assembly by the closed bottom of the base member. This eliminates any additional supporting frame and back cover, enabling simple assembly as well as reduction in weight.

Accordingly, it is a primary object of the present invention to provide a massage apparatus capable of being made lightweight and easy to assemble.

In a preferred form of the present invention, said racks are integrally molded with the base member for the purpose of further simplifying the assembly of the apparatus, which is therefore another object of the present invention.

Further included in the present invention is an advantageous design for the racks characterized in that they are curved longitudinally to fit a general contour of the back of the human body for presenting a comfortable and effective massaging force to the body as the massaging assembly moves along the racks.

It is therefore a further object of the present invention to provide a massage apparatus capable of giving a comfortable and effective massaging action to the back of the user.

The base member in the preferred form of the present invention is molded of fiberglass-reinforced plastic and is shaped to have on its bottom at least one concavo-convex formation, attaining sufficient mechanical strength at a minimum weight.

It is therefore a still further object of the present invention to provide a massage apparatus capable of being made lightweight while having sufficient strength for carrying the massaging assembly.

The base member is cooperative with the front cover to be employed as the backrest of a chair in the preferred form, in which a rail member is secured to each of the lateral sides of said base member to define therebetween a path which extends longitudinally along said rack for receiving therein guide roller means provided on said massaging assembly so as to movably retain the massaging assembly in the base member. Each of the paths formed along the lateral sides of the base member is open at its longitudinal or upper end of the rail member for allowing the corresponding roller means to be incorporated in and removed from the base member through that end opening upon assembly and disassembly of the massage apparatus. In the assembled position, a stopper detachably secured to each rail member closes the above end opening at the longitudinal or upper end of the corresponding path in such a way as to limit the length of movement of the massaging assembly along the lengthwise direction of the base member. With this arrangement, the massaging assembly can be easily incorporated in as well as easily removed from the base member, facilitating the assembly and disassembly of the apparatus.

It is therefore a further object of the present invention to provide a massage apparatus which can be easily assembled and disassembled as required for maintenance and inspection purposes.

In accordance with the present invention, there are disclosed other unique and useful features such as an arrangement for comfortably supporting the back of the user by a pair of side cushions on the lateral sides of the base member, an arrangement for readily incorporating a headrest in the base member, and an arrangement for preventing an accidental nipping of the user's fingers between the side cushion and the front cover. These and still other objects of the present invention will be more apparent from the following detailed description in conjunction with the attached drawings.

DETAILED DESCRIPTION OF THE DISCLOSURE

Figure 1:
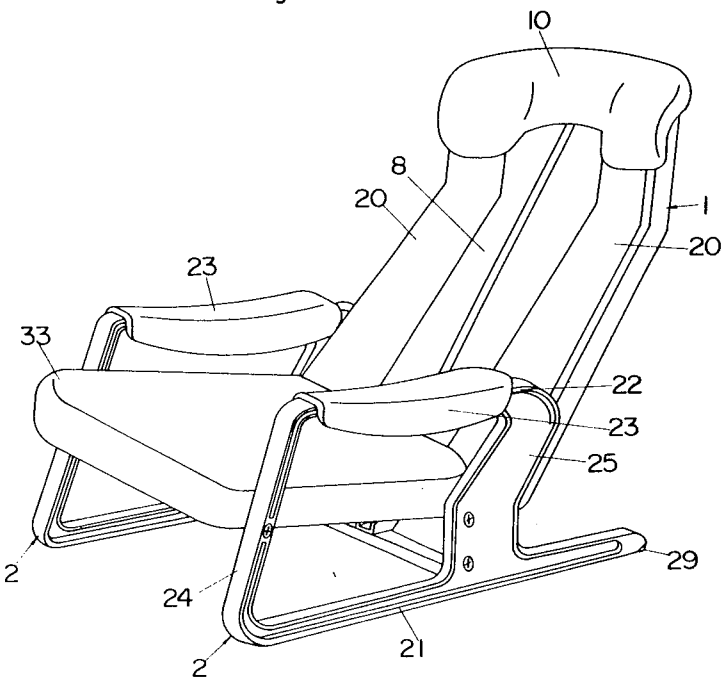
FIG. 1 is a perspective view of a preferred embodiment of the present invention being in the form of a reclining chair.
Figure 2:
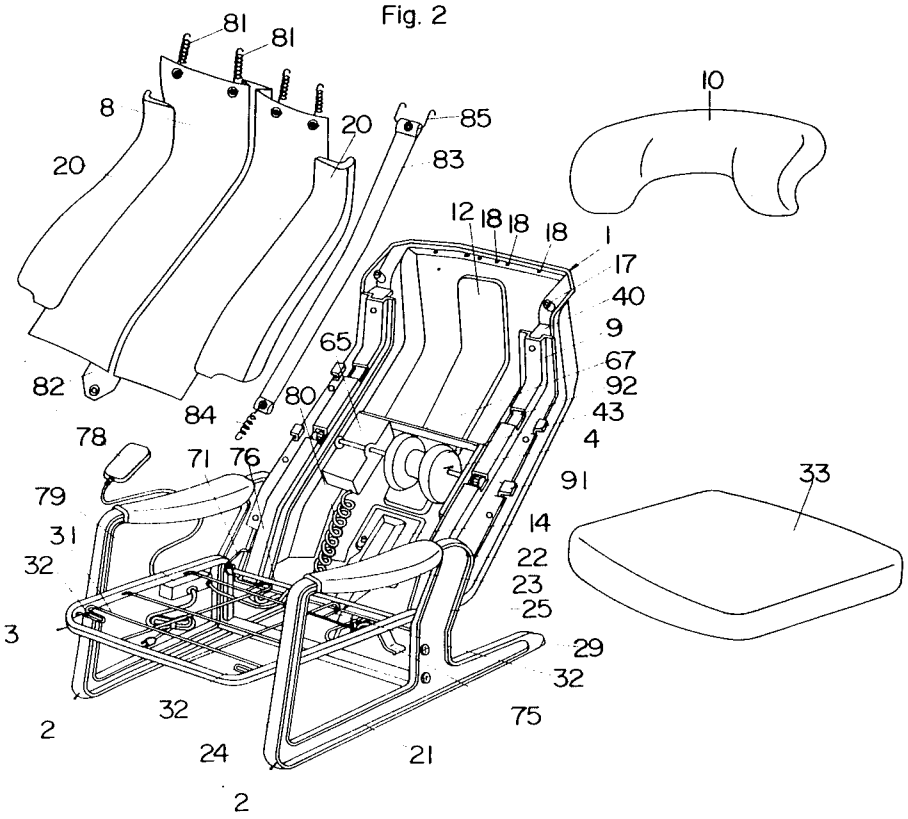
FIG. 2 is an exploded perspective view of the above chair.
Figure 3:
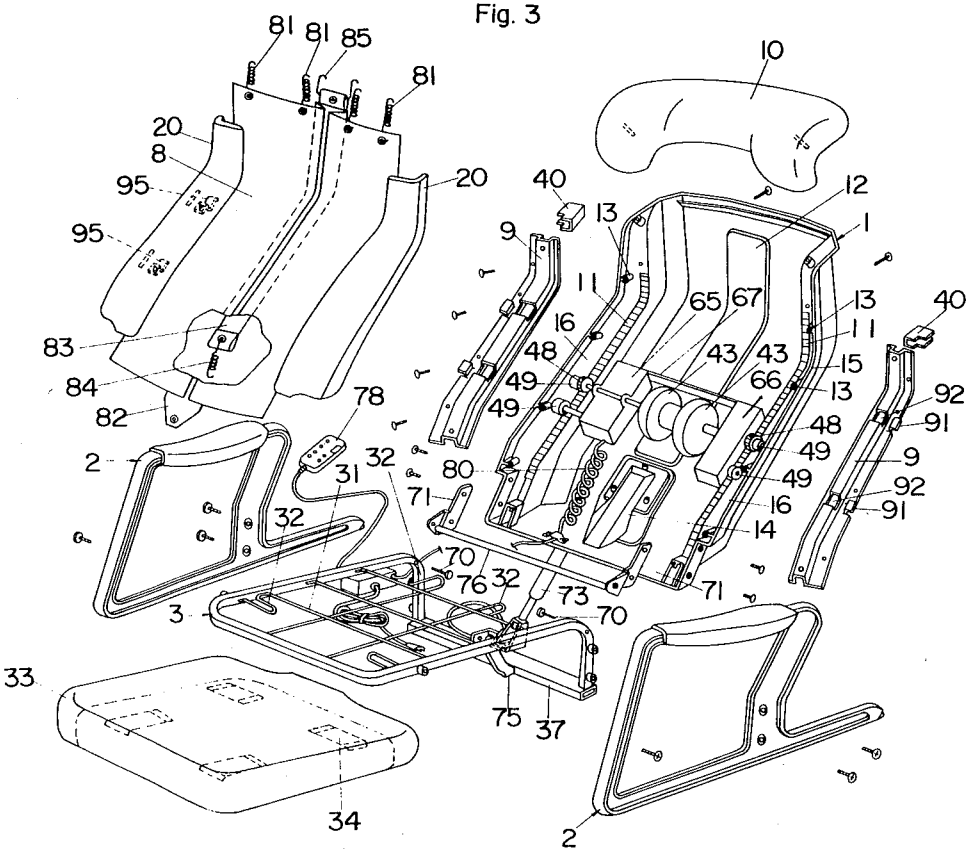
FIG. 3 is an exploded perspective view in a further exploded manner of the above chair.
Figures 5, 6:
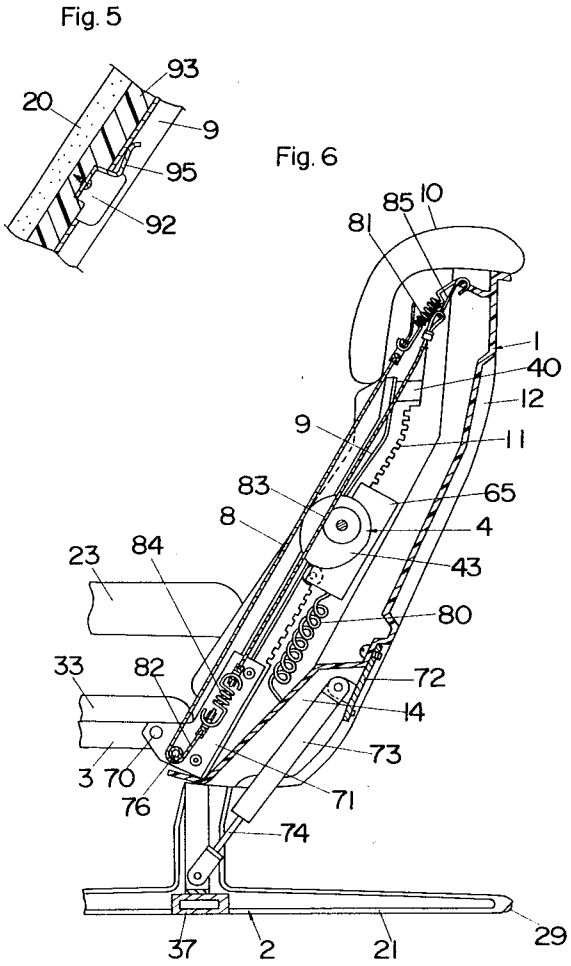
FIG. 5 is a partial sectional view illustrating the part of a rail member to which a side cushion is attached.
FIG. 6 is a longitudinal sectional view of the above chair partly being omitted.
Figure 9:
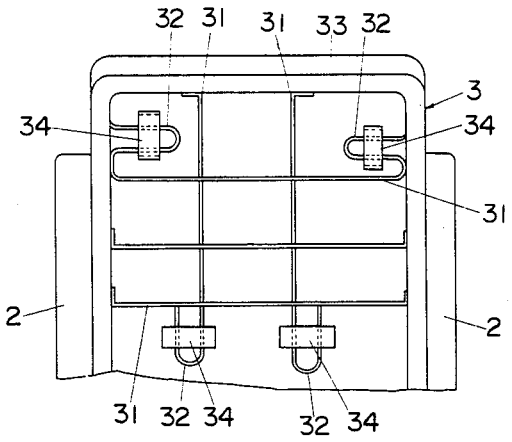
FIG. 9 is a bottom view of a seat frame of the above chair.

Referring now to FIGS. 1 through 3, there is illustrated a massage apparatus constructed in the form of a reclining chair in accordance with a preferred embodiment of the present invention. The chair has a framework composed of a pair of leg frames 2, a seat frame 3 connected between the leg frames 2, and a base member 1 connected to the seat frame 3. Both the leg frames 2 and the base member 1 are made of plastic material, particularly, the base member 1 is made of fiberglass-reinforced plastic such as unsaturated polyester resin for the purpose of increasing its strength. The seat frame 3 is a generally rectangular metal frame with a plurality of supporting wires 31 having integral hooks 32. A seat cushion 33 is securely placed on the seat frame 3 by the engagement of the hooks 32 with corresponding belts 34 on the underside of the seat cushion 33. As seen in FIG. 9, a total number of four hooks 32 of generally U-shaped configuration are formed in the seat frame 3 with front two ones being projecting inwardly and with rear two ones projecting backwardly, such that the hooks 32 once inserted in the corresponding belts 34 restrain the seat cushion 33 from shifting longitudinally and laterally so as to place it in position, preventing an accidental removal of the seat cushion 33 away from the seat frame 3. The seat cushion 33 is made of resilient matrial and is readily flexed for easy engagement of the hooks 32 with the belts 34. For example, the seat cushion 33 is readily fastened to the seat frame 3 by inserting the rear two hooks 32 followed by inserting the front two hooks 32 in the corresponding belts 34 while flexing the seat cushion 33. Each of said leg frames 2 is composed of an upper horizontal bar 22 with an armrest 23, a floor supporting horizontal bar 21, and front and rear vertical bars 24 and 25 connecting integrally the above horizontal bars and being respectively connected to said seat frame 3 by means of screws. Said base member 1 is pivotally connected at its lower end to the rear end of the seat frame 3 by means of hinge pins 70 to provide a reclining movement. In this connection, said floor supporting horizontal bars 21 extend backwardly in a greater amount than the upper horizontal bars 22 for stable supporting purpose. Attached to the rear end of each floor supporting horizontal bar 21 is a caster 29, as best shown in FIG. 6, by the operation of which the chair can be readily conveyed simply by lifting the front of the chair.

Figure 4:
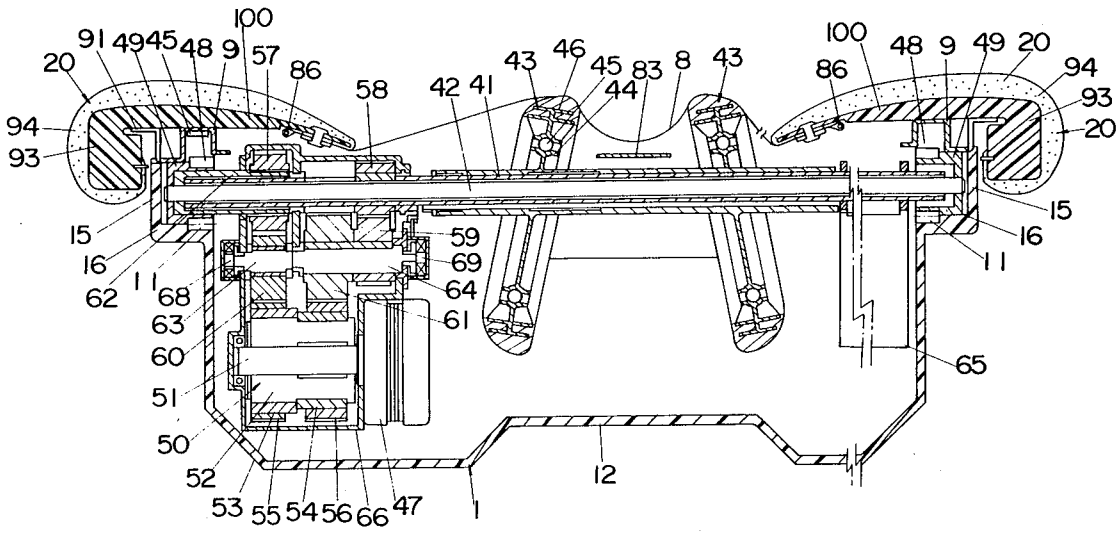
FIG. 4 is a transverse sectional view of the above chair.

Said base member 1 is a front open box with a closed bottom and side walls extending forwardly from the lateral sides thereof. The bottom of the base member 1 is formed with concavo-convex formations for strengthening purpose, one being a longitudinally elongated shallow rib 12 at the middle of the bottom and the other being relatively deep recess 14 at the lower end portion of the bottom. Said side walls of the base member 1 is generally Z-shaped in cross section, as best shown in FIG. 4, to have outer side walls 15 at the outermost portions and raised decks 16 inside of the side walls 15, the decks 16 extending longitudinally of the base member 1 to define runway surfaces which are in rolling contact with guide rollers 49 on a massaging assembly 4 hereinafter described. Adjacent to and just inside of each deck 16 there is formed integrally a rack 11 similarly extending longitudinally so as to be in meshing engagement of a pinion 48 provided on each side of the massaging assembly 4. The above decks 16 and racks 11 are arranged in a parallel relationship with each other and are curved so as to fit a general contour of the back of the human body. A plurality of posts 13 are formed on the inner surface of each outer side wall 15 for securing a rail member 9 to each lateral side of the base member 1. The rail member 9 is a metal-made channel member having a width enough to spread over the added width of said deck 16 and rack 11 at each lateral side of the base member 1, and cooperates with the confronting deck 16 to define therebetween a path for receiving and leading the guide rollers 49 of the massaging assembly 4 in the lengthwise direction of the base member 1. The rail member 9 is shaped to have the cross section of generally U-shaped configuration with outwardly extending flanges on both sides, the bottom of which being formed with longitudinally spaced slots 92 and the outer flange of which being formed with longitudinally spaced upstanding and outstanding ears 91. Both the rail member 9 and the rack 11 have lengths less than that of the base member 1 such that the upper ends of the rail member 9 and the rack 11 terminate at distances spaced downwardly from the upper end of the base member 1, leaving thereover a space for receiving a headrest 10 of suitable design.

As previously described, said base frame 1 is attached to the seat frame 3 so as to be allowed a reclining movement, the mechanism of which will follow. Fixed by screws to the lower end portions at the lateral sides of the base member 1 are a pair of hinge plates 71, which are in turn pivotally connected by said hinge pins 70 to the rear end of said seat frame 3. As shown in FIG. 6, a lift cylinder 73 is connected between the base member 1 and the seat frame 3 with its one end being secured to a mounting plate 72 fixed within said recess 14 and the opposite end secured to a rear stretcher 37. The lift cylinder 73 is a hydraulic cylinder having a piston rod 74 which is connected to a piston (not shown) carried within the cylinder and which has a valve for the admission of oil to one side or the other side of the piston, such oil being filled within the cylinder and pressurized by gas separately filled within the cylinder. A reclining lever 75 disposed below the seat frame 3 is operatively connected to said valve on the piston so as to open and close the valve for driving the piston rod 74. When the valve is opened by the operation of the reclining lever 75 for allowing the oil to flow through the piston, the piston is removed slowly by the difference between the total pressures applied to either sides of the piston so as to extend the piston rod 74, raising the base member 1 or the backrest in a gradual manner. On the other hand, the base member 1 is retained in a desired position with respect to the seat frame 3 when the valve is closed by the operation of the lever 75. The backrest can be inclined backwardly by pressing the same in that direction while maintaining the valve open.

Said massaging assembly 4 adapted to be movably supported on the base member 1 comprises a main shaft 41 extending transversely of the base member 1 and a pair of axially spaced massaging elements 43 mounted on the main shaft 41 to be driven thereby to rotate, the massaging elements 43 being eccentrically mounted on and inclined with respect to the axis of the shaft 41 in opposite directions to one another. As seen in FIG. 4, the main shaft 41 is in the form of a hollow shaft through which extends a drive axle 42 having at its one extended end a sleeve 62 fixed thereto in such a manner as to be freely rotatable on the main shaft 41, said sleeve 62 carrying said guide roller 49 and pinion 48 which are coaxially arranged and also freely rotatably on the main shaft 41. At the other extended end of the drive axle 42 are fixed the same guide roller 49 and the pinion 48. The guide rollers 49 on both ends of the drive axle 42 are respectively received within said paths so as to be in rolling contact with the corresponding runway surfaces or the decks 16, wherein the massaging assembly 4 is held on the base member 1 while allowed to move in the lengthwise direction of the base member 1. The pinions 48 on both ends of the drive axle 42 are brought in meshing engagement with the respective racks 11 on the base member 1 and are driven to rotate by the drive axle 42 so as to reciprocate the massaging assembly 4 longitudinally of the base member 1. A gearbox 66 is disposed at the end of the main shaft 41 adjacent to said sleeve 62 and a control box 65 is disposed at the other end of the main shaft 41, these boxes 65 and 66 being provided respectively with another guide rollers 49 in rolling contact with said runway surfaces and being interconnected by a transverse plate 67. Mounted on the gearbox 66 is a motor 47 which is drivingly connected to the main shaft 41 and the drive axle 42 through a gear train enclosed in the gearbox 66 for selectively driving the massaging elements 43 to rotate and the whole massaging assembly to reciprocate Included in the gear train is a differential gear assembly 50 which comprises a plurality of planet rollers 52 surrounding an output shaft 51 of the motor 47, a first outer ring 53, a second outer ring 54, a first output gear ring 55 and a second output gear ring 56, each planet roller 52 comprising first and second roller sections having a common axis parallel to the output shaft 51. The first roller section having a diameter larger than the second roller section is in rolling contact both with the output shaft 51 and the first outer ring 53, while the second roller section is in rolling contact only with the second outer ring 54. Said first and second output gear rings 55 and 56 fit closely on the respective first and second rings 53 and 54 to be rotatable together therewith. Also included in said gear train is a reduction gear assembly which comprises a first gear 60 fixed on a first rotatable shaft 63 to be in meshing engagement with the first output gear ring 55 and with a dirve gear 57 fixed on said sleeve 62, a second gear 61 fixed on a second rotatable shaft 64 to be in meshing engagement with said second output gear ring 56, and a pair of intermeshing elliptic gears 58 and 59 one being fixed on the second shaft 64 and the other fixed on said main shaft 41. Thus, there formed a first drive connection leading to the drive axle 42 from the motor 47 by the first outer ring 53, output gear ring 55, gear 60, drive gear 57, sleeve 62, as a second driving connection leading to the main shaft 41 is formed by the second outer ring 54, output gear ring 56, gear 61, elliptic gears 58 and 59. First and second magnetic brakes 68 and 69 are disposed in juxtaposition respectively to the ends of the first and second shafts 63 and 64 for selectively arresting these shafts. Thus, rotating the output shaft 51 of the motor 47 while applying a braking force to the first shaft 63 will lock the first output gear ring 55 and outer ring 53, whereby the planet rollers 52 are given a differential motion or rotation which results from the difference between the diameters of the first and second roller sections of said planet roller 52 and which is transmitted to the main shaft 41 through said second drive connection so as to rotate the massaging elements 43 thereabout at a greatly reduced speed. Conversely, when the second shaft 64 receives a braking force from the corresponding magnetic brake 69, the same differential motion is transmitted from the planet rollers 52 through said first driving connection to the drive axle 42 so as to rotate the pinions 49, whereby the whole massaging assembly 4 is moved along the racks 11 with which the pinions 49 mesh. Each of said massaging elements 43 comprises an eccentric inner ring 44 rotatively fixed on the main shaft 41 to be inclined with respect thereto and an outer ring 46 rotatably mounted on outer periphery of the inner ring 44 through a series of circumferentially spaced balls 45. With this arrangement, the massaging elements 43 serve to produce two different massaging actions, one is a kneading massage obtained by the massaging elements 43 being rotated eccentrically about the axis of the main shaft 41 as the main shaft 41 rotates, and the other is a rubbing massage obtained by the massaging elements 43 moving longitudinally along the racks 11 as the drive axls 42 rotates. These massaging actions are applied to the back of the body of the user resting on the chair through a front cover 8 of the base member 1. Within the control box 65 are received electric components constituting control circuit means for selectively actuating said magnetic brakes 68 and 69 as well as for reversing the motor 47. The control circuit means receives a control signal through a curled cord 80 from a controller 78 as well as receives power through the same cord from a power supplying box 79 which is connected to a conventional AC outlet.

Said front cover 8 spreading over the front opening of the base member 1 is made of a flexible material having a center pleat extending along the entire length thereof and is fastened at its peripheries to the base member 1. The upper end of the front cover 8 is fastened to the base member 1 by means of spring hooks 81 caught in respective eyelets 18 in the upper end of the base member 1. Both sides of the front cover 8 are fastened respectively to the lateral sides of the base member 1 by means of side cushions 20 and said rail members 9. At the lower end of the front cover 8 is formed a connection tab 82 which extends integrally from the middle of its width and is folded back about a bar 76 stretching between said hinge plates 71 so as to be connected to the lower end of a center belt 83 by means of a connection spring 84, as best shown in FIG. 6. Said center belt 83 is fastened at its upper end to the base member 1 by a hook member 85 caught in the eyelets 18 in the upper end of the base member 1 and extends along the underside of said center pleat of the front cover 8 to support the same, providing a soft and comfortable seating as well as preventing excess sinking in the chair. Said side cushions 20 extending along the substantial length of the base member 1 with the portions extending inwardly for supporting the sides of the back of the user. Each of side cushions 20 comprises a core member 93 made of plastic material to be of generally L-shaped configuration with an inwardly extending tapered flange 100 in transverse section and a cushioning member 94 covering the outer surface of the core member 93, the cushioning member 94 being further covered with a fabric. As shown in FIGS. 4 and 5, each side cushion 20 is securely connected to each lateral side of the base member 1 by said upstanding and outstanding ears 91 of said rail member 9 being inserted in the groove at the inner corner of the core member 93 at the same time by lugs 95 fixed on the undersides of said core member 93 being engaged with the inside of the rail member 9 after being inserted through the corresponding slots 92 thereof. Both lateral sides of the front cover 8 reach the inside of the innermost portions or the portions of a reduced thickness of the cooperative core members 93 and are riveted thereto at the portions just spaced inwardly of the folded side edges in which piano wires 86 are received to extend along the length of the front cover 8. Such piano wires 86 are employed to reinforce said riveted connection for preventing the breakage thereof and thus ensuring lasting firm connection between the front cover 8 and the side cushions 20. With the arrangement of the front cover 8 being riveted to the innermost portion of the core member 93 of each side cushion 20, there appears no substantial gap between the front cover 8 and each side cushion 20, such gap would otherwise be the cause for nipping the fingers of the user. Further, since the innermost portion of the core member 93 to which the front cover 8 is connected has a reduced thickness, it becomes resilient and responsible for applying a tension force to the front cover 8 in the transverse direction, presenting a comfortable seating.

Figure 7:
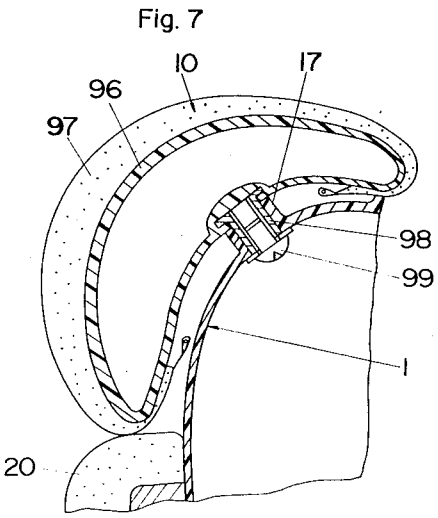
FIG. 7 is a fragmentary view in longitudinal cross section of a headrest attached to the upper end of the above chair.

Referring to FIG. 7, there is shown the headrest 10 attached to the upper end portion of the base member 1. The headrest 10 comprises a hollow core 96 of plastic material, the outer surface of which is covered by a cushioning member 97 with a covering fabric. Inserted to the rear wall of the hollow core 96 is an internally threaded fastener 98 which is received in a mounting boss 17 at the upper end of the base member 1 to be fixed thereto by a screw 99 inserted from the back of the base member 1.

Figure 8:
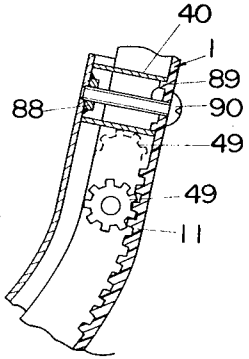
FIG. 8 is a fragmentary sectional view of a stopper detachably secured to the rack molded on the base member of the above chair.

Referring to FIG. 8, a stopper 40 is detachably connected between the base member 1 and each rail member 9 for preventing the overrun of the pinion 48 to determine the upper end of or limiting the length of the path within which said massaging assembly 4 can reciprocate. The stopper 40 is placed in a predetermined position by being fitted on protrusions 89 on the base member 1 and fixed in this position by a fastening screw 90 extending through the base member 1 to be threaded in a nut 88 fixed on the inner side of the rail member 9. Thus, the stopper 40 can be readily incorporated or removed simply by engaging or disengaging the fastening screw 90, such that the massaging assembly 4 can be easily mounted or dismounted from the base member 1 only by removing the headrest 10 and the stoppers 40.

The above description and particularly the drawings are set forth for purposes of illustration only. It will be understood that many variations and modifications of the embodiments herein described will be obvious to those skilled in the art, and may be carried out without departing from the spirit and scope of the invention.

What is claimed is:

1. A massage apparatus comprising:

a boxlike base member made of plastic material having contoured bottom and side walls extending forwardly from respective lateral sides thereof to form an open front;

racks formed integral with said respective side walls of said base member, each of said racks extending longitudinally along said base member;

rail members located at each lateral side of said base member walls forming first and second opposite guide paths over said racks;

a front cover spreading over said open front of said base member so as to define therebetween a mounting space, said front cover being fastened to said base member to form an enclosure by means of side cushions secured to said respective lateral sides of said base member, each of said side cushions extending longitudinally on said base member with one part thereof projecting inwardly into the front opening of said base member and having a cushioning material thereon, side edge portions of said front cover being secured respectively onto the innermost portions of said inwardly projecting parts of said side cushions; said front cover and base member forming a backrest of a chair;

massaging assembly positioned in said mounting space having first and second guide rollers located in said guide paths, and movable in a lengthwise direction upon said base member, wherein a massaging action is applied by said massaging assembly through said front cover to the back of the body of a user lying on said front cover, said massaging assembly including a gear box enclosing a gear train;

pinions coupled to said gear box for cooperating with said massaging assembly lengthwise along said base member, each of said pinion members being in meshing engagement with each one of said racks, such that said massaging assembly is movably carried in said enclosure while being retained in said guide paths; and a motor mounted on said gear box for selectively driving said massaging assembly, said motor capable of driving said massaging assembly along said racks in said lengthwise direction enclosed by said boxlike base member and front cover and applying massaging action to the body of said user through said gear train.

2. A massage apparatus according to claim 1 further comprising a stopper member detachably attached to one longitudinal end of each rail member for closing the guide paths at one end thereby limiting the travel of said massaging assembly.

3. A massage apparatus as set forth in claim 1, wherein each of said racks is curved longitudinally to fit a general contour of the back of the human body.

4. A massage apparatus as set forth in claim 1, wherein said back base is provided respectively at its longitudinal ends and lateral ends with means for fastening said front cover.

5. A massage apparatus as set forth in claim 1, wherein said base member is molded from fiberglass-reinforced plastic to have at least one concavo-convex formation on the bottom thereof.

6. A massage apparatus as set forth in claim 1, wherein said rail members terminates at a distance spaced inwardly from one longitudinal end of said base member so as to leave thereover a space for receiving a headrest.

* * * * *